US006895795B1

(12) United States Patent
Chaudhury et al.

(10) Patent No.: US 6,895,795 B1
(45) Date of Patent: May 24, 2005

(54) CONTINUOUS SEVERE PLASTIC DEFORMATION PROCESS FOR METALLIC MATERIALS

(75) Inventors: Prabir K. Chaudhury, Plano, TX (US); Raghavan Srinivasan, Beavercreek, OH (US); Srinath Viswanathan, Knoxville, TN (US)

(73) Assignee: General Dynamics OTS (Garland), L.P., St. Petersburg, FL (US)

( * ) Notice: Subject to any disclaimer, the term of this patent is extended or adjusted under 35 U.S.C. 154(b) by 242 days.

(21) Appl. No.: 10/180,701

(22) Filed: Jun. 26, 2002

(51) Int. Cl.[7] ..... B21C 23/00
(52) U.S. Cl. ..... 72/262; 72/253.1; 72/257; 72/270
(58) Field of Search ..... 72/253.1, 256, 72/257, 262, 270, 272, 282, 289

(56) References Cited

U.S. PATENT DOCUMENTS 3,922,898 A * 12/1975 Voorhes ..... 72/43
4,662,203 A * 5/1987 Kanatani et al. ..... 72/16.6
5,400,633 A 3/1995 Segal et al.
5,513,512 A 5/1996 Segal
5,600,989 A * 2/1997 Segal et al. ..... 72/253.1
5,620,537 A 4/1997 Bampton
5,780,755 A 7/1998 Dunlop et al.
5,809,393 A 9/1998 Dunlop et al.
5,826,456 A 10/1998 Kawazoe et al.
5,850,755 A 12/1998 Segal
5,904,062 A 5/1999 Semiatin et al.
6,197,129 B1 3/2001 Zhu et al.
6,209,379 B1 * 4/2001 Nishida et al. ..... 72/272
6,370,930 B1 * 4/2002 Lee et al. ..... 72/262
6,430,980 B1 8/2002 Weinhold et al.
6,571,593 B1 * 6/2003 Chung et al. ..... 72/262

* cited by examiner

*Primary Examiner*—Ed Tolan
(74) *Attorney, Agent, or Firm*—Hunton & Williams LLP

(57) ABSTRACT

A method of processing a billet of metallic material in a continuous manner to produce severe plastic deformation. The billet is moved through a series of CSPD dies in one operation to efficiently produce a billet characterized by a controlled grain structure. The long billets of metal stock are moved along the processing path through the CSPD dies with plural sets of pinch rolls which grip the billet and push it into the entry channel of the dies. Other sets of pinch rolls pull the billet from the exit channel of the dies.

36 Claims, 3 Drawing Sheets

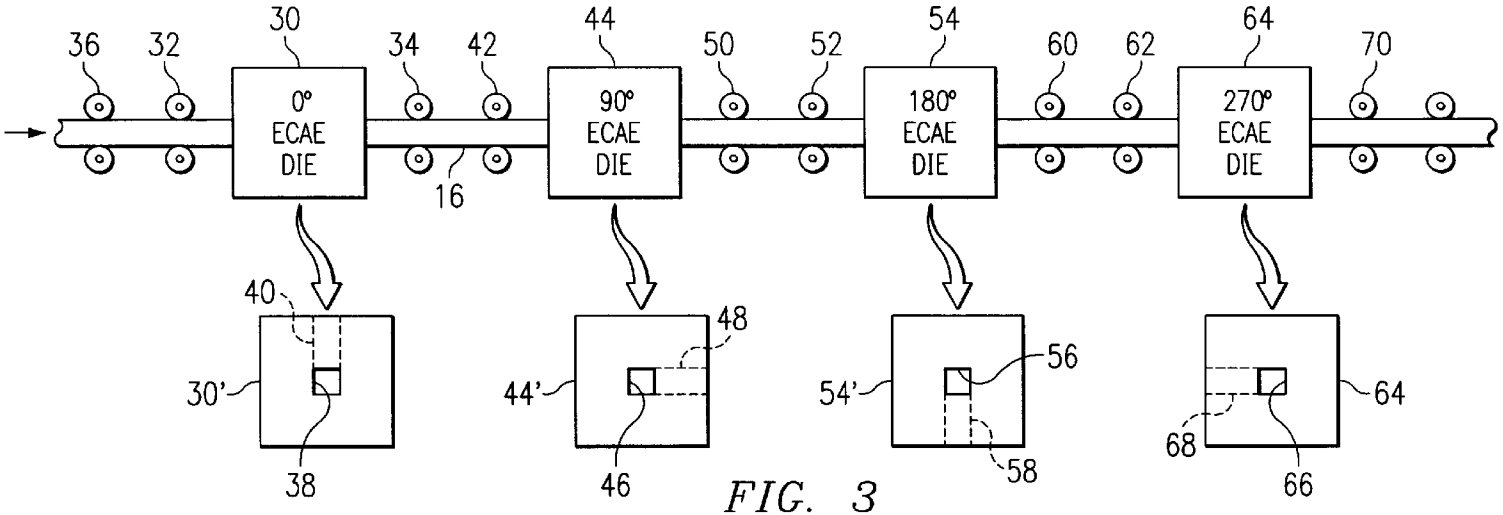
FIG. 3
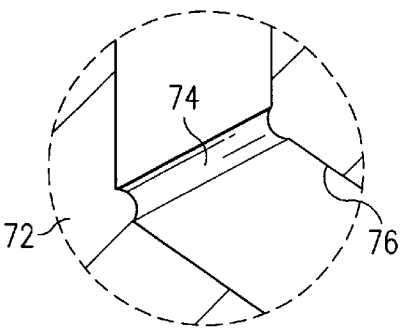
FIG. 4B
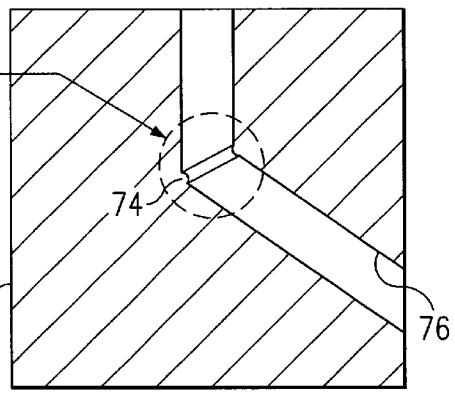
FIG. 4A
FIG. 4B

CONTINUOUS SEVERE PLASTIC DEFORMATION PROCESS FOR METALLIC MATERIALS

TECHNICAL FIELD OF THE INVENTION

The present invention relates in general to the processing of metallic materials, and more particularly to a method of fabricating continuous or semi-continuous billets or bars of metallic materials using severe plastic deformation techniques.

BACKGROUND OF THE INVENTION

The metal industry continues to require new materials for fabricating products that are improved in performance and are less costly to manufacture. Because of the vast differences in the characteristics of metals themselves, some materials are uniquely adapted for special uses. Steel, for example, has a high characteristic tensile strength and is easily formable in sheet form and thus is well adapted for stamping automobile body parts as well as a host of other commercial and consumer goods. However, steel has a high density and is not suitable for lightweight applications such as those in the aerospace industry. Aluminum, on the other hand, is light weight, but has a lower tensile strength, as compared to steel, and is not easily formable in sheet form, and is thus not well adapted for use in stamping automobile body parts. When stamping contoured parts, the sheet aluminum material becomes thinned and even breaks at the high stress locations, such as areas where sharp curves and corners are formed. Because of the requirements for higher strength and light weight materials in many modern applications, titanium has become a material of choice, especially in the aerospace industry, because of its high strength and light weight properties. The demand for higher strength and lower weight materials continues to grow and is becoming very important not only in aerospace industry but also in automotive industry. The use of high strength and low density materials in the automobile industry is becoming extremely important because of more stringent requirements to control environmental pollution and to conserve the fossil energy resources.

A relatively new process has been developed for increasing the tensile strength of aluminum, or other soft metals, in an attempt to fulfill the current and future demands for high strength and low density materials, while yet being easily formable in many metal-forming areas. The tensile strength of metals can be increased by many methods, one being a process by which the grain size of the metal is reduced and made very small. With a smaller grain size, the hardness and tensile strength of the metal is increased without compromising the ductility properties. The reduction in the grain size of a metal or alloy can be achieved by thermomechanical processing (TMP) where the material undergoes an extremely high degree of deformation. It is well known that when a metal undergoes severe thermomechanical deformation, the grain structure becomes smaller, and the material becomes correspondingly stronger at low temperatures. Many metal processing techniques are known which provide extremely large material deformations, including the well-known TMP techniques, the torsional/pressure technique, extrusion, and others. While yet in an experimental stage, softer metals can be hardened by undergoing a process called Equal Channel Angular Extrusion (ECAE), which is also known also Equal Channel Angle Pressing (ECAP). Because the processes are substantially identical, except for name, the process is referred to herein as the ECAE/P process. The ECAE/P process reduces the grain size of the metal by forcing the material through an angled die so that the metal undergoes a shear deformation without a corresponding change in the cross-sectional size thereof. A number of stages can be utilized so that the billet undergoes a shear deformation along different axes of the billet. This sequential shear deformation in the material can result in an ultrafine grain size, on the order of a few microns, or less. For a better understanding of the ECAE/P process, reference is made to the following U.S. patents: U.S. Pat. No. 5,620,537 by Bampton; U.S. Pat. No. 5,809,393 by Dunlop, et al; U.S. Pat. No. 5,826,456 by Kawazoe, et al; U.S. Pat. No. 5,904,062 by Semiatin, et al; and U.S. Pat. No. 6,197,129 by Zhu, et al. The ECAE/P process is well adapted for use with softer metals such as aluminum, copper, magnesium, nickel, titanium, and their corresponding alloys, and others. The shear strain to which these materials are subjected during the ECAE/P process increases the hardness thereof. These metals can thus be used in many other applications which heretofore rendered them unacceptable.

FIG. 1 illustrates, in a generalized manner, how billets are work hardened through the use of an ECAE/P die and a ram. The die 10 is constructed in a conventional manner with die steel or other suitable materials. Formed in the die 10 is an entry channel 12 and an exit channel 14. The ratio of the diameter or side of the channel cross sections to the respective length of the channels is typically in the range of 1:4 to 1:8. The entry channel and exit channel are not colinear, but rather are formed at an angle $\Phi$ with respect to each other. As the die angle $\Phi$ becomes smaller, more shear is imparted to the billet 16. In addition, the channels 12 and 14 are substantially identical in cross-sectional size and shape, and thus the billet 16 being processed does not change in cross-sectional shape as it is moved through the die 10. The principle of operation of the ECAE/P technique is that as the billet 16 is forced through the angled portion of the channel, where the entry channel 12 joins the exit channel 14, the billet undergoes a severe plastic deformation. Repeated deformation of the material through the die causes the grain structure to become smaller, thereby increasing the hardness of the billet 16.

In a conventional process, the billet 16 is pushed through the die 10 by a hydraulic ram 18. As can be appreciated, the length of the billet must be somewhat short so that the billet does not buckle at the entrance of the entry channel 12. Billet cross sections on the order of about 1 inch to 2 inches in diameter or side dimensions have been processed through ECAE/P dies in this manner. With a limitation of short billets, in connection with the diameter/length ratios noted above, there is inherently a substantial amount of waste associated with the process, it being realized that the frontal end and rear end parts of each billet may be unusable. The ECAE/P method of work hardening a metal is thus acceptable for short billets. Hence, where the fabrication of large metal work pieces is necessary, the use of ECAE/P processed metals is not presently economically feasible.

It can be seen from the foregoing that a need exists for a process that can produce long billets of metallic materials using ECAE/P methods. Another need exists for a metal processing system that can produce large quantities of ECAE/P-hardened metals, with substantially lower energy requirements for carrying out the process. Yet another need exists for a method of continuous processing of long metal billets through successive ECAE/P dies to thereby achieve large quantities of ultrafine grain, hardened materials adapted for new and existing uses. Another need exists for a process where ultrafine grain materials can be produced by severe plastic deformation techniques, with less waste.

SUMMARY OF THE INVENTION

Disclosed is a method of fabricating ultrafine grain-hardened metals using a Continuous Severe Plastic Deformation (CSPD) method, where the process is carried out on a continuous or semi-continuous basis so that longer and larger billets of ultrafine grain, hardened metals can be produced. The CSPD dies are very similar to the ECAE/P dies but with different channel diameter/length ratios. The channel lengths of the CSPD dies are made shorter to reduce the friction between the billet and the CSPD die. In accordance with the principles and concepts of the invention, large and/or long billets of a metal are continuously fed to one or more CSPD dies arranged in a series. In a preferred form of the invention, the raw billets are continuously fed to a CSPD die by a set of push/pull rolls that grip or roll the billet and force it through the die. The set of push rolls are arranged on opposing sides of the long billet for gripping or rolling the billet and for pushing the billet into the die. The pull rolls also grip or roll the billet in a similar manner and are arranged to pull the billet from the die. Hence, the rolls can operate on continuous lengths of billets to thereby allow much longer billets of processed metals to be produced. When employed in a series of dies, the pull rolls of one die station can also function as the push rolls for the next downstream die station. The downstream dies are oriented in such a way that they can provide the effect of rotating the continuous billet in a desired angle as it is moved through the CSPD dies in a sequence. These die orientations can be changed in a manner so that the process can produce either equiaxed or elongated microstructure metals.

In accordance with an optional feature of the invention, a small annular constriction can be formed in the exit channel of a CSPD die to reduce the friction between the die and the billet. In this case, the cross section of the billet moving through the entry channel of the die is reduced slightly, thus producing less friction as the billet is moved through the exit channel. Another optional feature is that the rolls used in the plastic deformation process can be flat or shaped. In either case, the billet, as it is rolled, can be deformed in a variable amount depending on the roll shape, rolling, and billet configuration. In addition, the force generated by the rolling operation before entering and after exiting the die can be applied by a conveyor type or tank-wheel track arrangement powered by one or more sets of rolls.

According to one aspect of the invention, there is disclosed a method of processing metallic materials by severe plastic deformation thereof, comprising the steps of providing at least one die with an angled bore through which a billet of the metallic material is moved, where the angled bore is structured so that the billet undergoes a severe plastic deformation when moved therethrough, and using a transport mechanism for gripping a side surface of the billet and moving the billet through the die, whereby a long length billet can be processed.

According to another aspect of the invention, there is disclosed a method of processing metallic billets by severe plastic deformation thereof, comprising the steps of providing at least a first and second die for causing severe plastic deformation of the billets when moved through the respective dies, arranging the dies in series such that at least a portion of the billet being processed is positioned in both said dies at the same time, and moving the billet simultaneously through said first and second dies so that severe plastic deformation of the billet occurs at different locations thereof at the same time, whereby long length billets can be processed.

According to a further aspect of the invention, there is disclosed a die for use in severe plastic deformation of a metallic material, comprising a body with an angled bore formed therein so that when the metallic material is forced through the angled bore of said die, the metallic material experiences severe plastic deformation, the angled bore is characterized by an entrance channel and an exit channel, the respective axial axes of the entrance channel and the exit channel are angled, and wherein a channel diameter/length ratio of the die is in the range of about 1:1 to about 1:2.

DESCRIPTION OF THE DRAWINGS

Further features and advantages will become apparent from the following and more particular description of the preferred and other embodiments of the invention, as illustrated in the accompanying drawings in which like reference characters generally refer to the same parts, elements, or components throughout the views, and in which:

FIG. 3 is a diagram of a system of CSPD die stations where the billet undergoes plastic deformation along four different shear planes of the billet;

FIG. 4 illustrates a cross-sectional view of a low friction CSPD die where contact between the billet and the exit channel of the CSPD die is minimized by employing an annular rib formed in the entrance area of the exit channel;

DESCRIPTION OF THE INVENTION

Figure 1:
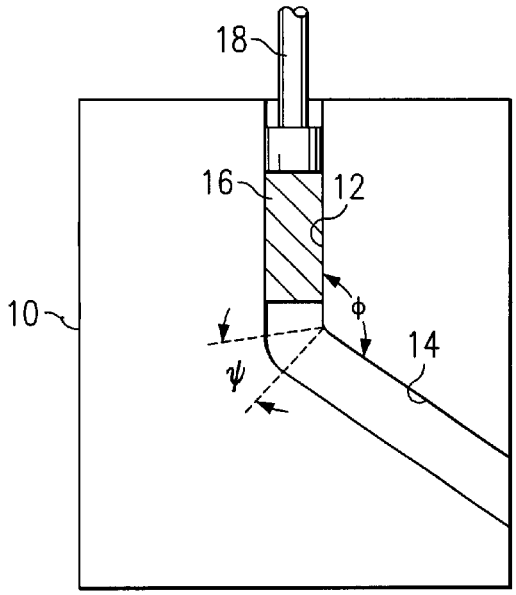
FIG. 1 is a generalized diagram of an ECAE/P die and a press mechanism for pressing short length billets through the die.
Figure 2:
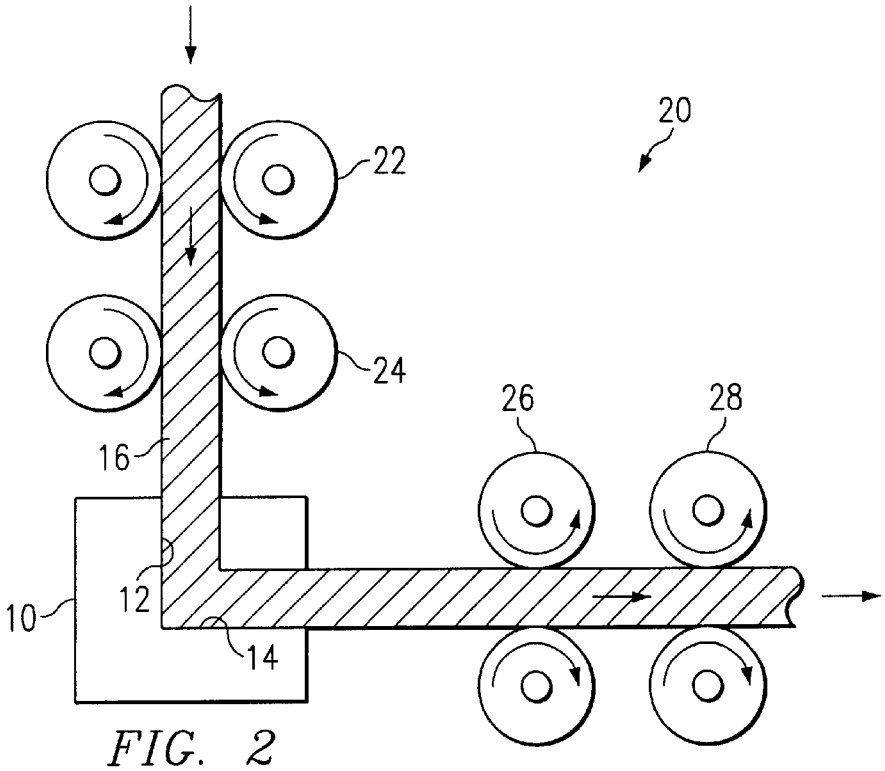
FIG. 2 is a diagram illustrating one embodiment of the invention in which rolls are employed in providing continuous movement of long billets through the CSPD die.

With reference now to FIG. 2, there is illustrated an embodiment showing the principles and concepts of the invention. A Continuous Sever Plastic Deformation (CSPD) die 10 is constructed with an internal path having an angle (Φ) of about 90 degrees, although any other angle can be employed. The CSPD die 10 may be of a construction the same or similar to a conventional ECAE/P die shown in FIG. 1, although it is preferable to construct the CSPD die 10 with a channel diameter/length ratio in the range of about 1:1 to about 1:2. With such type of die ratios, there is much less friction between the billet 16 and the die 10. By using a CSPD die 10 having a 90 degree angle between the entry channel 12 and the exit channel 14, a maximum shear strain equivalent to a tensile strain of about 1.0 can be achieved. Importantly, the billet 16 need not be short, as was required when using a ram-type force to move the billet 16 through the die. Rather, the billet 16 is constrained and carried through the system by grasping the billet 16 on its side surfaces to create a pushing force and/or a pulling force on the billet 16. Since the side surface of the billet 16, whether it be round, oval, square, rectangular, or otherwise, is always available throughout its length (except the portion inside the die), the force to move the billet 16 can be exerted at any available location along the billet 16. This greatly facilitates the ease in exerting a forward directed movement of long billets 16 at numerous side surface areas thereon. By the proper positioning of the mechanisms for gripping the side surfaces of the billet 16, the billet 16 can be routed through a number of serially-arranged CSPD dies, as well as through other billet processing systems, such as induction heaters, rollers, cutters, etc. It should be understood that many different metal materials, including powder metallurgy billets, can be processed according to the invention.

In one embodiment of the invention shown in FIG. 2, the billet 16 is moved through the CSPD die 10 by a billet moving mechanism 20 comprising one or more sets of rolls. One set of rolls is shown as reference numeral 22. Each set of rolls is preferably driven by a motor, such as an electric motor, to move the billet 16 at substantially the same rate through the severe plastic deformation system. Depending on the placement in the system, the rolls can either push the billet 16 through a die, or pull the billet 16 from the die, or both. Roll sets 22 and/or 24 can be effective to push the billet 16 into the entry channel 12 of the CSPD die 10. Similarly, the roll sets 26 and/or 28 can be effective to pull the billet 16 from the exit channel 14 of the die 10. In FIG. 2, the die 10 may be the sole die employed, or used in conjunction with other dies. When used as the second or subsequent die in a multi-die plastic deformation system, a first set of rolls 22 can be used to grip the side surfaces of the billet 16 and pull the billet 16 from the preceding CSPD die (not shown). A second set of rolls 24 can be positioned adjacent the entry channel 12 of the die 10 and function to push the billet 16 into the die 10. The second set of rolls 24 is preferably positioned sufficiently close to the entry channel 12 so as to prevent buckling of the billet 16. The set 24 of spaced-apart rolls is adapted to engage the side surface of the billet 16 so as to exert a force thereon to push the billet 16 through the die 10.

A third set of rolls 26 is located adjacent the exit channel 14 of the CSPD die 10. The third set of rolls 26 functions to grip the side surfaces of the billet 16 and exert a pulling force to pull the billet 16 from the die 10. In the event that the CSPD die 10 is disposed in a plastic deformation system upstream of another die, then a fourth set 28 of rolls can be utilized to exert a pushing force for pushing the billet 16 into the entry channel of the subsequent downstream die (not shown). With this arrangement of push and pull pinch rolls, the length of the billet 16 is not limited, and the billet 16 can be routed through a multi-station system.

The rolls utilized for the push and pull functions can be of conventional construction, such as the type well known for use with rolling mills. Indeed, a rolling mill station can be employed to initially form the billet 16 in a desired cross-sectional shape prior to undergoing severe plastic deformation in a CSPD die. The rolls are machined or otherwise formed with a peripheral edge having a shape complementary to the shape of the outer surface of the billet 16. This provides for a large surface area for frictional contact between the roll gripping surface and the billet 16. As can be appreciated, the larger the surface area contact between the rolls and the billet 16, the larger the push/pull force that can be imparted to the billet 16. Various structures can be utilized to increase the gripping area between the roll surface and the billet 16. For example, the rolls can have a knurled gripping surface area to achieve a better bite on the side surface of the billet 16. Other surface configurations of rolls can be used to maximize the friction between the roll surface and the billet 16. In the event the billet 16 is of a material that is somewhat hard, additional sets of rolls can be used to push or pull the billet in a forward direction. In other words, by employing a severe plastic deformation system using CSPD die(s), there may be plural sets of drive rolls located at the entry channel of a die, and plural sets of rolls located at the exit channel of the die. Because the billet 16 continues to become harder after it undergoes a series of severe plastic deformations, an increased force is necessary to drive the billet 16 through the downstream dies. As such, an increased number of roll sets may be required to move the billet 16 through the respective dies. Conversely, the plastic deformation stations located at the input end of the system may not need a set of pull rolls and a separate set of push rolls between dies. Rather, one set of rolls may be adequate for providing a pull function on the billet 16 for the upstream billet, and for also providing a push function on the billet 16 for the adjacent downstream die. An adequate frictional contact is required between the gripping surfaces of the rolls and the billet 16, while at the same time it is desired to minimize the friction between the billet 16 and the inner surfaces of the CSPD die channels. It is contemplated that the billet 16 will be lubricated as it is forced through each CSPD die. An oil type of lubricant can be sprayed on the billet as it enters the entry channel of each die.

While not shown, a billet guide structure may be employed between each set of push rolls and respective dies. The guide structure may have a funnel-shaped bore for guiding the frontal end of the billet 16 into the entry channel of the die. The continuous movement of the billet 16 from one die to a subsequent die is thus facilitated, thereby eliminating labor efforts in manually feeding a billet 16 from one severe plastic deformation station to another.

Those skilled in the art may find that billets of certain cross-sectional shapes may be better adapted for gripping on the side surfaces thereof, especially by roller mechanisms. For example, billets having a round or oval cross-sectional shape provide a substantial surface area for contact with a complementary-shaped roller. Accordingly, it may be advantageous to utilize a set of shaped rolls to form the billet into a desired cross-sectional shape for movement through the dies, and use a final mill roll set to form the billet in the final cross-sectional shape for other uses. It is preferable, although not absolutely necessary, to utilize die channels with the same shape as the billet being processed. Hence, mill rolls providing desired billet shapes can be used in conjunction with other rolls that function solely to grip the billet and provide a continuous movement thereof through the multi-die system. In order to optimize the efficiency of the system, the mill rolls can be designed and driven so as to provide both the function of shaping and the function of movement of the billet in a forward direction.

FIG. 3 is a diagram of a multi-die severe plastic deformation system constructed according to one embodiment of the invention. In this embodiment, the billet 16 is characterized as a long continuous metal workpiece that is simultaneously processed through a number of CSPD die stations. The dies are arranged to provide a homogeneous grain size throughout the material of the billet 16, all in one continuous operation. In the context of the invention, the word continuous does not mean that each billet has no end, but that the billets which can be processed according to the invention are long in length. Stated another way, it is a conventional practice to either intentionally make billets short for ECAE processing, or to cut the billets into short lengths so as to accommodate the ECAE systems presently used. With the present invention, billets as long as can be obtained can be processed directly through the CSPD systems of the invention. In practice, it is anticipated that the length of billets typically processed according to the principles and concepts of the invention will be in the neighborhood of about twenty times the cross-sectional width, or longer. There is no inherent upper limit to the length of the billets, as it is possible to continuously process billets as they are being made from molted metal, and thereafter the hardened material can be cut into appropriate lengths for shipping to manufacturers for fabricating into goods.

As noted above, the process of hardening the billets can also be semi-continuous. A semi-continuous process can be one in which the hardening procedure is interrupted for various reasons. For example, such a process may be employed when the billet must undergo eight passes through a CSPD die system, and there are only four dies in the system. In this event, when the billet has completed four plastic deformations through the four dies, the process is momentarily interrupted so that the processed billet can be brought back to the input of the system to undergo four additional plastic deformations. While each pass through the system may be considered continuous, the overall procedure may be periodically interrupted and thus be thought of as semi-continuous. Other examples of a semi-continuous process may be where the billet is processed to utilize only one direction of a die to achieve special microstructures, or where only a single die is used for multiple passes of a billet therethrough.

The first CSPD die 30 receives the billet 16 as it is moved forwardly by a set of push rolls 32 and a set of pull rolls 34. The roller set 36 may be a pull roller from an upstream processing station, or may function to shape the billet 16 into a desired cross-sectional shape. It is assumed for purposes of example that the billet 16 is square in cross-sectional shape. The first CSPD die 30 functions to make the grain size of the billet 16 smaller. The depiction of the die 30' shows the axial orientation of the die 30, particularly the entry channel 38 with respect to the exit channel 40, which is oriented upwardly. The billet 16 is pulled from the exit channel 40 by the pull roll set 34. The billet 16 is moved from the pull roll set 34 to the push roll set 42 of the next downstream CSPD die 44. The second die 44 of the system is rotated 90 degrees, as shown by the die 44'. Here, the second die 44 is rotated so that the exit channel 48 is directed to the right with respect to the entry channel 46. The pull roller set 50 directs the billet 16 from the second station to the push roll set 52 of the third station.

The third station employs a third CSPD die 54 for providing further plastic deformation of the billet 16. The orientation of the third die 54 is axially rotated another 90 degrees, as shown by the die 54'. In the third station, the exit channel 56 is oriented downwardly with respect to the entry channel 58. The plastic deformation of the billet 16 in the third station occurs along yet another plane of the billet 16, thereby making the grains of the billet 16 finer and more homogenous. As can be appreciated, with the metal deformation resulting from each station, the billet 16 becomes harder and stronger. Importantly, the cross-sectional shape and size of the billet 16 does not substantially change when processed through the CSPD die system. Lastly, the billet 16 is pulled from the station three die 54 by pull roll set 60 and again pushed into the entry channel 66 of the station four CSPD die 64. In the processing of the billet 16 in station four, severe plastic deformation of the metal is achieved at a different angular orientation. The fourth die 64 is oriented at an angle such that the exit channel 68 is directed to the left with respect to the entry channel 66. In the event that the CSPD dies are formed with 90 degree (Φ) channels, a maximum strain can be achieved in the billet 16. After the billet 16 undergoes a severe plastic deformation in each die, the strain imparted thereto either approaches or is substantially equal to unity. After the billet 16 undergoes processing through four such dies, the accumulated strain in the billet 16 may be on the order of about four. A uniform and fine grained (nanocrystalline) structure can thereby be achieved in a very efficient and cost effective process.

The foregoing process in which the billet undergoes sequential CSPD station processing is much preferred over prior extrusion processes where a billet undergoes strain by way of plastic deformation caused by extrusion dies. When processed through an extrusion die, the cross-sectional shape of the billet changes. The strain required to produce fine grains in metals can range from 2 to 6. This range of strains corresponds to extrusion ratios in the range of about 7:1 to 300:1, the latter ratio of which may be required for breaking prior particle boundaries of PM processed material. The extrusion process is limited by the amount of product that can be produced because of limitations in the size of the extrusion chamber and the large frictional stresses that can develop between the workpiece and the extrusion chamber.

In the utilization of a drawing process in conjunction with an ECAE die, a limitation is the tensile strength of the billet. The tensile failure of the billet limits the maximum strain to about 0.63. An additional limitation of using a drawing process with an ECAE die is separation of the billet material from the sidewall of the die, especially at the outer corner of the angle between the entry and exit channels. This problem is generally overcome by using draw rolls in conjunction with push rolls (where the rotational speed of the rolls is the same), and the use of ECAE-type dies where the cross-sectional area of the billet does not substantially change during the process. When such a combination of processing steps and equipment is employed, separation of the billet from the sidewalls of the die is either substantially minimized or eliminated altogether.

In the system of FIG. 3 the billet 16 itself does not undergo any angular rotation. Rather, the dies are each positioned so that the billet 16 is directed via the respective exit channels in four different directions to thereby provide small metal grains uniformly distributed throughout the billet material. Those skilled in the art may find that the ECAE or CSPD dies can be oriented in the same manner, but cause the billet to be rotated before entry into the subsequent die. To that end, rotation of the billet can be achieved by spiraling the exit channel a desired amount to thereby effectively rotate the billet. Other types of rotating apparatus can be positioned between dies to achieve the rotation of the billet.

While the embodiment of the billet processing system shown in FIG. 3 involves severe plastic deformation at four different angular orientations, it is well within the ambit of the invention to employ fewer or more dies, each oriented at different angular orientations. While the use of many dies achieves a more homogenous distribution of ultrafine grains, the billet becomes harder and more difficult to move through the downstream dies. The intended application of the billet material may dictate the hardness required and thus the particular angle between the entry channel and the exit channel of the die. The number of dies employed in the system is proportional to the homogeneity of the metal grains.

FIG. 4 illustrates the construction of a CSPD die 72 adapted for reducing friction with a billet passing therethrough. An annular rib 74 is formed in the exit channel 76 at the entrance end thereof. The rib 74 forms a small constriction for narrowing the cross-sectional area of the billet as it is forced through the angled die passage and into the exit channel 76. The rib 74 can be formed as part of the exit channel 76 so as to reduce the cross-sectional area of the billet by approximately 3%. The resulting reduction in the cross-sectional area of the billet minimizes the friction between the billet and the internal sidewalls of the exit channel 76. Less force is thus required to move the billet through the die 72. In the event a downstream die is used, the force required to push the billet into the entry channel thereof causes the billet to expand somewhat and return the cross-sectional area of the billet to that which existed prior to processing by the previous upstream die.

Figure 5:
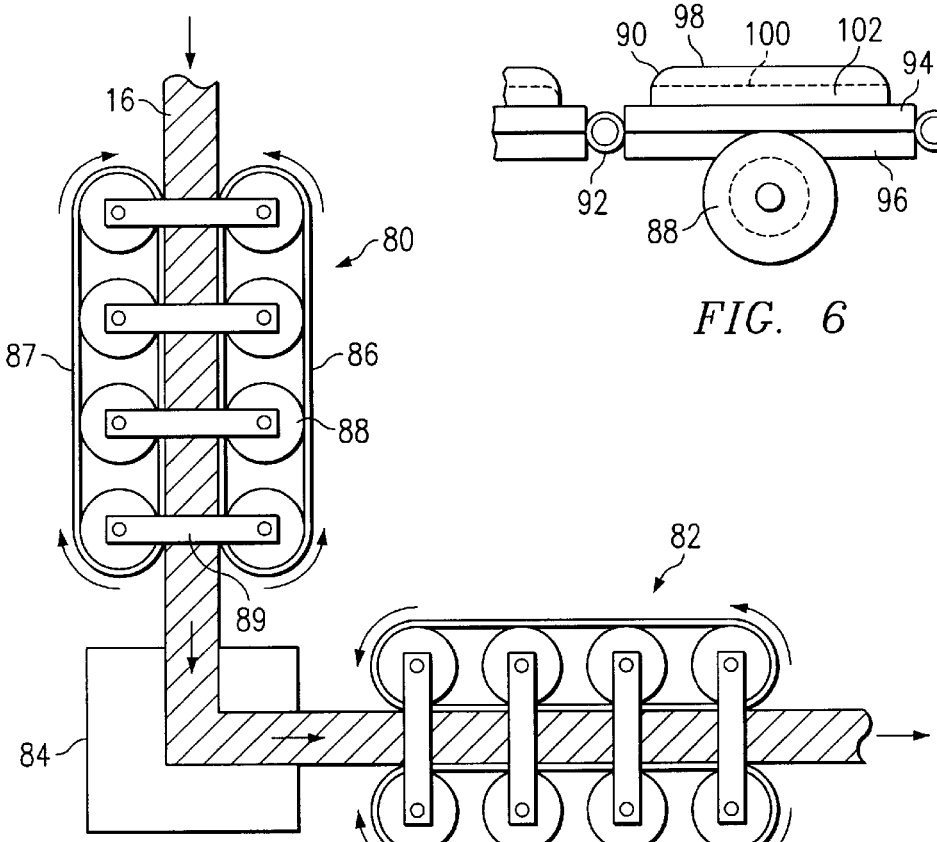
FIG. 5 is a drawing showing a conveyor type or tank-wheel track mechanism that can be used in gripping billets and forcing the same through the dies.

While rolls can function as one transport mechanism for moving the billet through the CSPD dies, other transport mechanisms may also be adapted for forcing the billets in a forward direction. In the event a large frictional grip is needed to produce a correspondingly large force on the billet, a moving track transport mechanism can be used. An example of a motive conveyor or track system is shown in FIG. 5. Such an apparatus may function similar to tracks on a military tank or earth moving equipment. The track itself can have a number of grips for gripping the opposing side surfaces of the billet. Alternatively, the tracks may be comprised of a train of concave plates connected together for engaging the opposing surfaces of the billet. Preferably, one track mechanism would be positioned on each side of the billet. With this arrangement, a large surface area of the billet is engaged with the track mechanism, thereby providing a large frictional contact therewith.

With specific reference to the motive track system shown in FIG. 5, there is shown a pair of push tracks 80 and a pair of pull tracks 82, each operative to force a billet 16 through a CSPD die 84. In the same manner described above, each pair of tracks can function as both a push mechanism for a downstream die and a pull mechanism for an upstream die. Each track has an associated grip structure, which may be a continuous loop belt, or a linked structure. The grip, for example grip 86 of track 80, is continuous and is driven by one or more support rollers 88. The rollers 88 can be driven individually, in tandem or in any other manner so long as they all rotate at the same rate. The rollers 88 are driven so as to move the grip 86 in the direction noted by the arrows. The rollers associated with one grip 86 are held in a spaced-apart manner from the rollers associated with the companion grip 87 by respective support bars, such as identified by a reference numeral 89. Each roller 88 can be constructed so that the peripheral surface thereof is shaped to conform to a shape of the drive surface of the grip 86. Importantly, the frictional engagement between the grip 86 and the rollers 88 is sufficient to prevent slipping therebetween when the billet 16 is forced through the die 84. It is contemplated that the grip 86 will be constructed with a number of individual members that are coupled together for articulated movement around the various rollers. The track associated with push grip 87 is constructed in the same manner as grip 86. In like manner, the pair of grips and the rollers of the push set of tracks 82 is constructed in the same manner as described above. The push or pull function of each pair of tracks is realized as a function of whether the pair is situated upstream from the die 84, or downstream. Otherwise, the sets of tracks are structured and operated in the same manner. As noted above, the outer surface of each grip is shaped to conform to the shape of the billet 16 to thereby optimize the frictional engagement therebetween.

Figure 6:
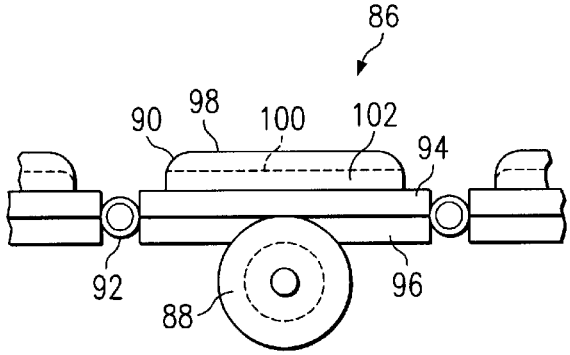
FIG. 6 is a side view of a track link employed for engaging and driving a billet into a die.
Figure 7:
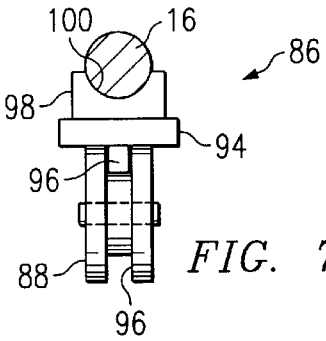
FIG. 7 is an end view of the track link apparatus of FIG. 6.

The linked nature of the track, for example track 86, is shown in FIGS. 6 and 7. Each link 90 of a track is hinged together at a connection 92 with a conventional pin arrangement. The link 90 includes a base plate 94 with a rail 96 formed on the underside thereof. The rail 96 is shaped to conform to the peripheral surface of the roller 88. In the example illustrated, the rail has a rectangular edge and the roller 88 has a corresponding shaped rectangular groove 96 formed therearound. Other drive configurations, such as meshing teeth, are possible. On the upper surface of the base plate 94 there is formed a grip 98 with a trough 100 for frictional engagement with the billet 16. The surface of the trough 100 can have a knurled or other type of roughened surface for increasing the frictional engagement with the side surface of the billet 16. The trough 100 is formed with a rounded left and right edge 102 to accommodate the billet 16 as the links are driven around the front and back end rollers of the track. With a rounded edge 102, the links do not gouge or otherwise severely indent the billet 16. As can be appreciated from FIG. 7, a companion track link (not shown) overlies the billet 16 and is spaced from the bottom link so that the billet is squeezed between the respective upper and lower troughs of the links. Because the troughs of the companion tracks are substantially semicircular, a majority of the surface area of a round billet is available for engagement by the pair of tracks. While a billet with a round cross-sectional shape can be engaged by a track having a rounded trough, the trough shapes can be oval, triangular, rectangular or other shapes to accommodate billets of corresponding shapes.

Figure 8:
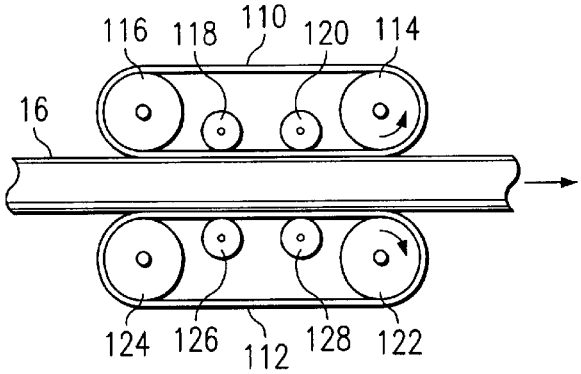
FIG. 8 is a diagram of another embodiment of a "tank track" type of a billet transport system.

FIG. 8 illustrates another embodiment of a tank-track billet transport mechanism. Here, a pair of tank-type tracks 110 and 112 is held in a spaced apart manner by conventional means. In order to provide a large contact surface area on the billet 16, the upper track 110 can be constructed with a 24-inch diameter front and back drive roll, namely rolls 114 and 116. The large rolls 114 and 116 are driven by respective electric motors, or any other suitable drive means well known in the art. The front and back rolls 114 and 116 can be spaced apart about 48 inches. In addition, smaller 8-inch rolls 118 and 120 can be located 16 inches apart, between the large rolls 114 and 116, and in contact with the bottom portion of the track 110. The smaller rolls 118 and 120 are not driven, but rather are freely rotatable so as to apply an additional compressive force on the bottom portion of the track 110. The bottom track 112 is provided with large drive rolls 122 and 124 and smaller rolls 126 and 128 in a similar manner. When the tank-track apparatus of FIG. 8 is employed as a transport system for an 8-inch square metal workpiece, the total contact surface area is 384 square inches. This is more than a sufficient contact surface area to force an 8-inch square billet 16 through a CSPD die according to the invention.

Assuming a flow stress of 20,000 psi for a conventional material such as aluminum, the force required to move the 8-inch square aluminum billet through the CSPD die is about 1,280,000 lbs, or 640 tons. This force must be imparted to the opposite side surfaces of the square billet. Further assuming a sticking friction of about 10,000 psi (about one-half of the flow stress), the required contact area between the tracks 110 and 112 is about 64 square inches. If an efficiency of 50% is assumed, with a friction factor of 0.5 (rather than 1.0 for sticking friction), the required linear contact length of the transport mechanism on the billet is 32 inches. As can be seen, the 48 inch surface area length of the transport drive mechanism of FIG. 8 is sufficient to force the billet through the CSPD die.

In accordance with the foregoing, another advantage can be realized from the processing of billets characterized with ultrafine grain sizes. While these billets are characterized by a high hardness factor at room temperature, such material often becomes easily forgeable when subjected to higher temperatures. When the equicohesive temperature of a metal is exceeded (about fifty percent of the absolute melting temperature), a decrease in the grain size leads to a decrease in the flow stress of the material. The reduction in the flow stress that typically occurs can be mathematically represented as the amount that the grain size has been made smaller, raised to the power of about 1.5 to about 2.5. In other words, a decrease in the grain size by a factor of 2 can potentially decrease the flow stress by a factor of about 2 to 6. For example, in the processing of aluminum billets according to the invention, the resulting ultrafine grain metal can be forged at a temperature of 600 degrees F., rather than the traditional forging temperature of 900 degrees F. This makes the fabrication or forging of products more economical and requires less energy for the fabrication steps. Moreover, with the availability of large billets having ultrafine grain structures, many more products can be fabricated.

While the preferred and other embodiments of the invention have been disclosed with reference to specific apparatus and techniques, it is to be understood that changes in detail may be made as a matter of engineering and design choices without departing from the spirit and scope of the invention, as defined by the appended claims.

What is claimed is:

1. A method of processing metallic materials by severe plastic deformation thereof, comprising the steps of:

providing at least a first and second die with respective angled bores through which a billet of the metallic material is moved, each said angled bore being structured so that the billet undergoes a severe plastic deformation when moved therethrough; and using a first transport mechanism for gripping a side surface of the billet and for pushing the billet through the first die;

using a second transport mechanism for gripping a side surface of the billet and for pushing the billet through the second die; and continuously processing the billet through said first die and then through said second die, whereby a long length billet can be processed.

2. The method of claim 1, further including providing the first and second transport mechanisms with respective opposing gripping surfaces through which the billet extends.

3. The method of claim 2, wherein said first and second transport mechanism each comprise a pair of spaced-apart rolls for gripping the billet therebetween.

4. The method of claim 3, further including using rolls that each have a peripheral contoured surface for gripping the billet between said respective peripheral surfaces and moving the billet through the respective die.

5. The method of claim 3, further including using a first set of rolls to push said billet through said first die, and using a second set of rolls functioning to pull said billet through said first die.

6. The method of claim 5, further including driving a respective gripping surface of each said set of rolls at substantially the same rotational speed.

7. The method of claim 1, further including moving billets of length greater than about one foot through each said die.

8. The method of claim 1, further including using a transport system that moves billets having lengths independent of the operation of a movement of the billet into the die.

9. The method of claim 1, further including reducing a cross-sectional area of the billet in an exit channel of a die of the type having an entry channel angled with respect to the exit channel of the die.

10. The method of claim 9, further including reducing the cross-sectional area of the billet by using an annular internal rib in said exit channel.

11. The method of claim 1, further including first moving the billet from said first die to said second die during a continuous movement of the billet.

12. The method of claim 11, further including using a respective transport mechanisms positioned at entry and exit locations of said first and second die.

13. The method of claim 12, wherein each said transport mechanism is substantial identical in operation.

14. The method of claim 11, further including using one transport mechanism to push the billet into the first die, and using a second transport mechanism to pull the billet from the first die.

15. The method of claim 14, further including using said second transport mechanism to push the billet into said second die.

16. The method of claim 1, further including using a plurality of dies, each said die having a respective angled bore spatially oriented in a different orientation so that said billet is moved through each said die in a single processing step to thereby undergo a material deformation at different planes of the billet.

17. Apparatus for carrying out the method of claim 1.

18. The method of claim 1, further including heating the metallic material before pushing the metallic material into said die.

19. A method of processing metallic billets by severe plastic deformation thereof, comprising the steps of:

providing at least a first and second die for causing severe plastic deformation of the billets when moved through the respective dies;

arranging the dies in series such that at least a portion of the billet being processed is positioned in both said dies at the same time;

moving the billet simultaneously through said first and second dies so that severe plastic deformation of the billet occurs at different locations thereof at the same time, whereby long length billets can be processed, and said moving step including using a plurality of transport mechanisms, each of which has a respective gripping surface which grips a side surface of the billet, and positioning a first transport mechanism at an inlet of said first die for pushing the billet into said first die, positioning a second transport mechanism between an outlet of said first die and an inlet of said second die, said second transport mechanism for pushing the billet into said second die, and positioning a third transport mechanism at an outlet of said second die for pulling the billet from said second die.

20. The method of claim 19, wherein each said die has an entry channel and an exit channel, an axis of said entry channel and an axis of said exit channel of each die defining a respective plane, and further including axially aligning the exit channel of the first die with the entry channel of said second die, and aligning the first die in a plane that is not parallel to a plane of said second die.

21. The method of claim 19, further including a third and fourth die, and arranging the first, second, third and fourth dies in a serial manner so that the billet is moved through each said die, and providing an angular orientation to each die so that the billet undergoes four different severe plastic deformations as the billet is moved through said dies.

22. The method of claim 21, further including providing said first, second, third and fourth die, all constructed in substantially the same manner.

23. The method of claim 19, further including processing the metallic billets through a rolling mill before being directed to the entry channel of said first die, and using rolls of said rolling mill to support said billet and direct said billet to the entry channel of said first die.

24. Apparatus for carrying out the method of claim 19.

25. A method of processing metallic materials by undergoing severe plastic deformation thereof, comprising the steps of:

arranging a plurality of dies in a serial manner so that the metallic material forced out of an exit channel of one die is directed toward an entry channel of a downstream die, the channels of each die defining a processing path of the metallic material moving therehrough;

arranging the plurality of dies so that the metallic material undergoes severe plastic deformations in different planes thereof as the metallic material passes through the respective dies; and pushing the metallic material into the entry channel of each said die, and pulling the metallic material from the exit channel of each die, thereby allowing the material to be serially processed through the dies.

26. The method of claim 25, further including using rolls to grip the metallic material and move the metallic material along the processing path.

27. The method of claim 26, further including using two pairs of spaced-apart rolls, each pair of rolls for gripping the metallic material therebetween and moving the metallic material through the processing path, and using one pair as input rolls to push the metallic material, and using another pair as outlet rolls to pull the metallic material.

28. The method of claim 27, further including using the input rolls to push the metallic material into the die at substantially the same speed as the outlet pair of rollers are used to pull the metallic material from the die.

29. The method of claim 25, further including processing the metallic material through a plurality of said dies at the same time.

30. The method of claims 25, further including processing the metallic material through four different die to provide severe plastic deformations of the metallic material in four different planes thereof.

31. The method of claims 30, further including orienting the first die in a predefined orientation, orienting the second die so as to be rotated about 90 degrees with respect to said first die, orienting the third die so as to be rotated about 180 degrees with respect to said first die, and orienting the fourth die so as to be rotated about 270 degrees with respect to said first die.

32. The method of claim 25, further including using dies having respective entry channels angled with respect to respective exit channels, and where the exit channels are at least partially spiraled to provide rotation of the metallic material when forced therethrough.

33. The method of claim 32, wherein the exit channels of the respective die are spiraled to provide rotation of the metallic material about 90 degrees.

34. Apparatus for carrying out the method of claim 25.

35. A die for use in severe plastic deformation of a metallic material, comprising:

said die having a body with an angled bore formed therein so that when the metallic material is forced through the angled bore of said die, said metallic material experiences severe plastic deformation; and said angled bore characterized by an entrance channel and an exit channel, respective axial axes of said entrance channel and said exit channel being angled, and wherein a channel cross-sectional size/length ratio of said die is in the range of about 1:1 to about 1:2.

36. The die of claim 35, wherein said exit channel has a bore that is at least partially spiraled to provide rotation of the metallic material as said metallic material passes therethrough.

* * * * *

UNITED STATES PATENT AND TRADEMARK OFFICE

CERTIFICATE OF CORRECTION

PATENT NO. : 6,895,795 B1
APPLICATION NO. : 10/180701
DATED : May 24, 2005
INVENTOR(S) : Prabir K. Chaudhury et al.

It is certified that error appears in the above-identified patent and that said Letters Patent is hereby corrected as shown below:

Column 1, line 5, insert the following paragraph:

--This Invention was made with U.S. Government support under Contract No. DE-FC36-01ID14022 awarded by the Department of Energy. The Government has certain rights in this invention.--

Signed and Sealed this

Twenty-fifth Day of December, 2007

JON W. DUDAS
*Director of the United States Patent and Trademark Office*